US008302369B2

(12) United States Patent
Jelacic

(10) Patent No.: US 8,302,369 B2
(45) Date of Patent: Nov. 6, 2012

(54) MODULAR ANGLE TRIM

(75) Inventor: Richard Jelacic, Castle Hill (AU)

(73) Assignee: Top Idea Australia Pty Ltd, Smithfield, New South Wales (AU)

( * ) Notice: Subject to any disclaimer, the term of this patent is extended or adjusted under 35 U.S.C. 154(b) by 166 days.

(21) Appl. No.: 12/864,300

(22) PCT Filed: Jan. 29, 2009

(86) PCT No.: PCT/AU2009/000085

§ 371 (c)(1),
(2), (4) Date: Jul. 23, 2010

(87) PCT Pub. No.: WO2009/094698

PCT Pub. Date: Aug. 6, 2009

(65) Prior Publication Data

US 2010/0300008 A1 Dec. 2, 2010

(30) Foreign Application Priority Data

Jan. 30, 2008 (AU) ..... 2008900404

(51) Int. Cl.

| | |
|---|---|
| ***E04D 13/15*** | (2006.01) |
| ***E04D 13/068*** | (2006.01) |
| ***E04B 1/38*** | (2006.01) |
| ***E04F 19/02*** | (2006.01) |

(52) U.S. Cl. ..... 52/848; 52/592.1; 52/12; 52/716.1

(58) Field of Classification Search ..... 52/12, 716.1, 52/717.05, 717.06, 848, 592.1
See application file for complete search history.

(56) References Cited

U.S. PATENT DOCUMENTS

| | | | | |
|---|---|---|---|---|
| 5,257,482 | A * | 11/1993 | Sichel | 52/12 |
| 5,321,920 | A * | 6/1994 | Sichel | 52/12 |
| 5,555,687 | A | 9/1996 | Logan et al. | |
| 6,128,881 | A | 10/2000 | Bue et al. | |
| 6,393,788 | B1 | 5/2002 | Flores | |
| 6,729,100 | B2 | 5/2004 | Koski et al. | |
| 6,938,379 | B2 * | 9/2005 | Groom | 52/12 |
| 7,047,702 | B1 | 5/2006 | Callens et al. | |
| 7,146,774 | B2 | 12/2006 | Fredette | |
| 7,278,243 | B2 | 10/2007 | Jones et al. | |
| 7,287,746 | B2 * | 10/2007 | Fehr et al. | 261/97 |
| 7,377,498 | B2 * | 5/2008 | Fehr et al. | 261/97 |
| 7,931,419 | B2 * | 4/2011 | Skrabs | 403/329 |

OTHER PUBLICATIONS

International Preliminary Report on Patentability, WIPO, Mar. 13, 2009.

* cited by examiner

*Primary Examiner* — Robert Canfield
(74) *Attorney, Agent, or Firm* — Hodgson Russ LLP

(57) ABSTRACT

An angle trim (20) is provided. The angle trim (20) includes a first elongated strip (22) having first (24) and second (26) opposed ends. A second elongated strip (28) projects at an angle from an elongated side (30) of the first strip (22) along the length of the elongated side (30). A tongue member (32) extends from the first end (24) of the first strip (22) at a raised height above the upper surface of the first strip (22). A channel (34) is arranged adjacent the second end (26) of the first strip (22) above the upper surface. The channel (34) is adapted to receive the tongue member (32) of another angle trim to connect the angle trims in an end to end relationship without requiring overlap of the first strips of the angle trims.

5 Claims, 2 Drawing Sheets

MODULAR ANGLE TRIM

FIELD OF THE INVENTION

The present invention relates to angle trims as used to cover and attach to elongated corner portions of objects.

BACKGROUND TO THE INVENTION

Angle trims are used to cover and attach to objects having elongated corner portions. As an exemplary example, consider mesh cover guards for rain-water guttering. Rain-water guttering collects and channels away rain-water collected from roofs. However, guttering can also collect solid objects, such as leaves, which remain in the guttering. This can cause blockage of the guttering. Furthermore, such collection of leaves in guttering can provide a fire-risk in bush-fire prone areas.

Mesh-gutter guards are known to provide a filter for guttering. While the mesh allows rain-water through to the guttering as intended, the mesh prevents solid objects such as leaves entering the guttering. An example of such a mesh gutter-guard is illustrated in FIG. 1 and is described in Australian Innovation Patent No. 2005100465, the contents of which are incorporated by way of reference. As shown, the mesh 1 is arranged across the upper open channel 4*a* of the guttering 4. One edge of the mesh 1 is secured between roof tiles 3, 5. The other edge of the mesh 1 is secured to the outer corner 8 of the guttering 4. Typically, as shown, an angle trim 10 is used to cover and secure the outer edge of the mesh 1 to the outer corner 8 of the guttering 4.

In practice, angle trims come in unwieldy lengths of several metres. Given that the installation of a mesh gutter guard is performed high off the ground, the handling of long lengths of angle trim can prove difficult for one person to do alone and may require additional help. While the angle trim can be cut to size, individual installers may cut the angle trim to more manageable lengths of a metre or less. The problem, when using a number of smaller lengths of angle trim, is that in use adjacent angle trims are required to be secured overlapping each other to provide a continuous length of angle trim. This overlapping between adjacent lengths of angle trim is not desirable. The resultant angle trim can be unsightly and the installation of which can add difficulties. As such, the installation of mesh gutter guards can prove impractical for the lay person, thus requiring professional installers.

It is an object of the present invention to provide an improved angle trim which can be conveniently handled.

SUMMARY OF THE INVENTION

According to the present invention there is provided an angle trim, including:

a first elongated strip having first and second opposed ends;

a second elongated strip projecting at an angle from an elongated side of the first strip along the length of the elongated side;

a tongue member extending from the first end of the first strip at a raised height above the upper surface of the first strip; and a channel arranged adjacent the second end of the first strip above the upper surface;

wherein the channel is adapted to receive the tongue member of another angle trim to connect the angle trims in an end to end relationship without requiring overlap of the first strips of the angle trims.

Preferably, the tongue member is an integrally formed portion of the first strip.

In exemplary embodiments, the channel is integrally formed with the first strip. Ideally, the channel is integrally formed by deforming a portion of said first strip.

In preferred embodiments, the angle trim further includes one or more holes formed through the first strip to receive one or more fastening members.

The present invention advantageously provides a modular angle trim which can be connected length to length with other modular angle trims without needing overlap.

DESCRIPTION OF PREFERRED EMBODIMENT

Figure 1:
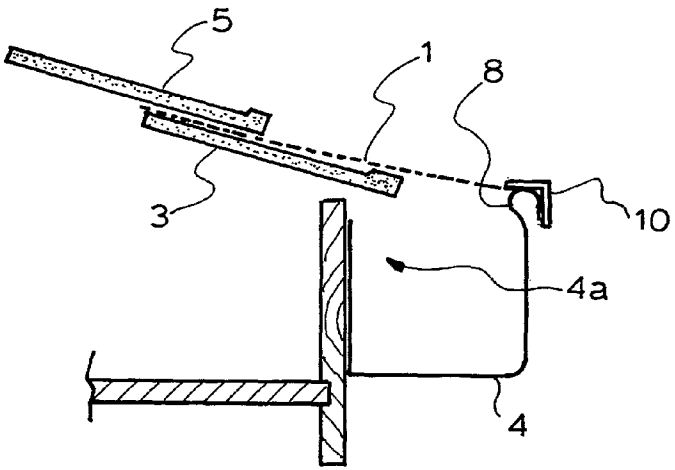
FIG. 1 illustrates a cross-sectional view of a mesh gutter guard arrangement.
Figure 2:
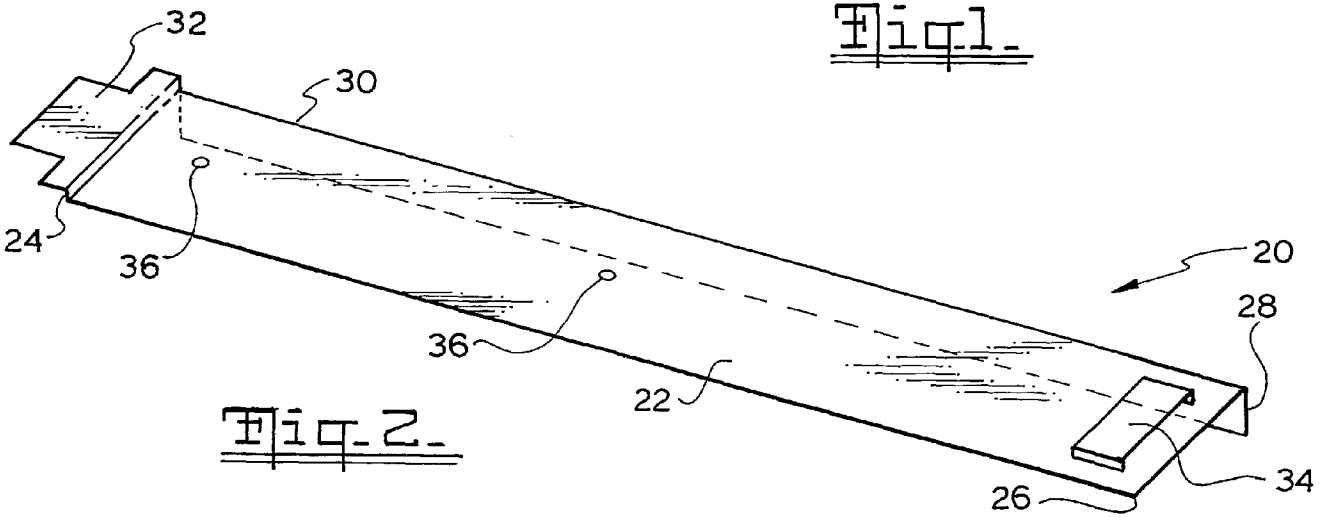
FIG. 2 illustrates a modular angle trim according to a preferred embodiment of the present invention.

FIG. 2 shows a preferred form of an angle trim 20. The angle trim 20 has a first elongated strip 22 having first 24 and second 26 opposed ends. A second elongated strip 28 projects at an angle from an elongated side 30 of the first strip 22 along the length of the elongated side 30. Typically, the second elongated strip 28 projects at right angles to the first strip 22. However, it will be appreciated that different angles could be employed. As will be appreciated, the second strip 28 can be formed by lengthwise bending a primary elongated strip by any suitable means.

The angle trim 20 can be any suitable length. For ease of handling, a length of 0.5 m has been found to be convenient.

The angle trim 20 can be formed of any suitable material, such as various metals or plastic materials. For outdoor usage, a weather-durable material should be employed, such as plastics material, stainless steel or aluminium.

Arranged at the first end 24 of the first strip 22 is a tongue member 32. The tongue member 32 extends from the first end 24 at a raised height above the upper surface of the first strip 22. Ideally, as shown, the tongue member 32 is integrally formed with the first strip 22 by suitable cutting and bending during formation of the angle trim 20.

Arranged adjacent the second end 26 of the first strip 22 is a channel 34 on the upper surface of the first strip 22. Ideally, as shown, the channel 34 is integrally formed with the first strip 22. Conveniently, the channel 34 could be formed by any suitable cutting and deforming process during formation of the angle trim 20.

Figure 3:
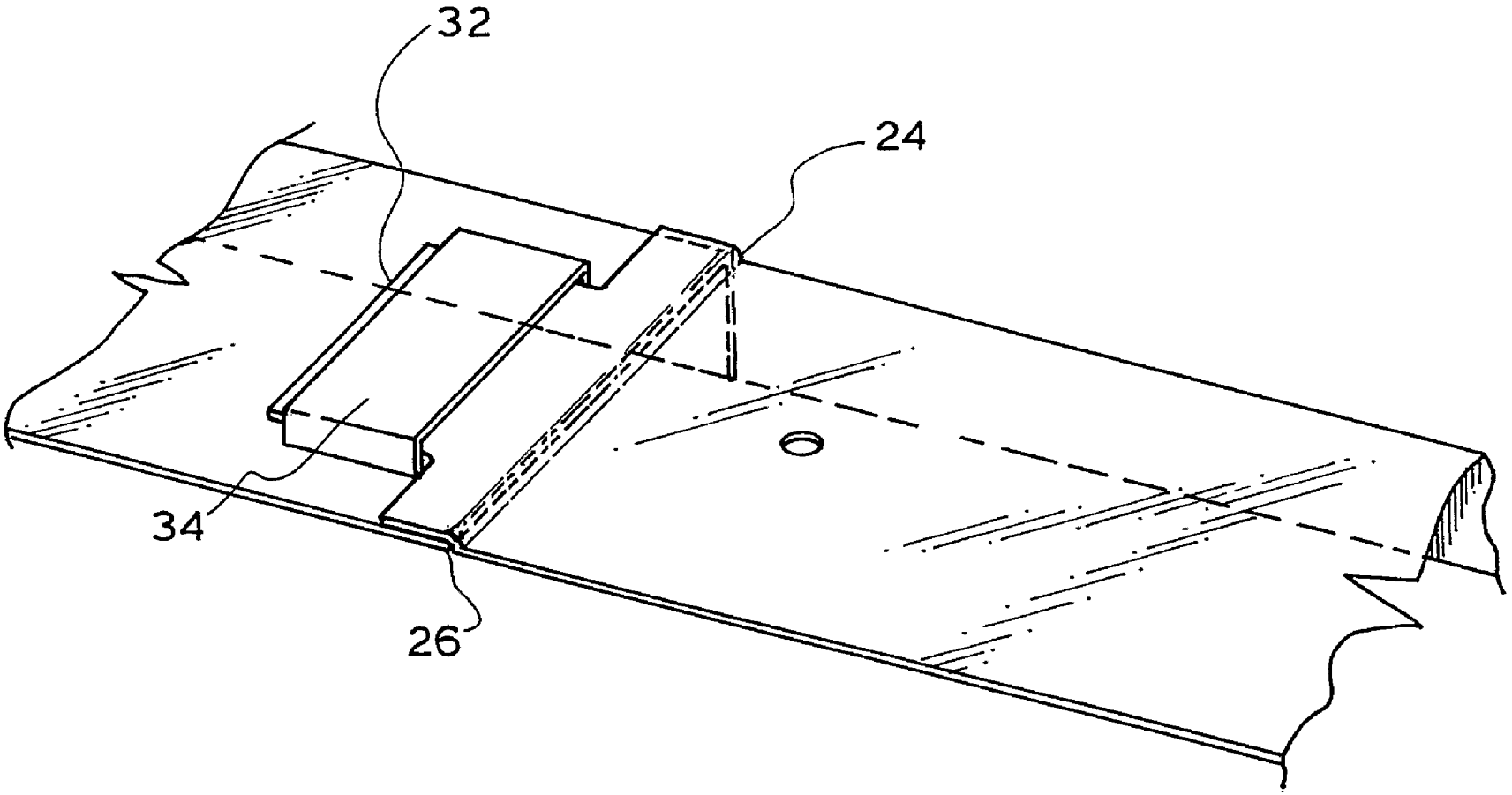
FIG. 3 illustrates the connection of two modular angle trims.

The channel 34 is arranged so as to be capable of receiving a tongue member 32 from another angle trim, see FIG. 3. In this manner, the angle trims 20 can be connected end to end and maintain the respective first strips 22 level without overlap.

Ideally, as shown, the first strip 22 includes preformed holes 36. The preformed holes 36 provide a convenient location for any fastening members (not shown), such as rivets or screws etc., when installing the angle trim 20 on and along a corner 8.

While the present invention has been described with respect to a specific embodiment, it will be appreciated that various modifications and changes could be made without departing from the scope of the invention.

What is claimed is:

1. An angle trim for use in the installation of gutter guard on rain water roof guttering, the angle trim including:

a first elongated strip having first and second opposed ends, said first strip being shaped and sized to be fastened to an upper surface of an outer corner of said guttering, with an outer edge of said gutter guard being secured between said first strip and said outer corner;

a second elongated strip projecting at an angle from an elongated side of said first strip along the length of said elongated side to form a substantially L-shaped profile whereby, upon installation, said second strip extends downwards from said first strip to hide the outer edge of said gutter guard;

a tongue member extending from the first end of said first strip at a raised height above the upper surface of said first strip; and a channel arranged adjacent said second end of said first strip above said upper surface;

wherein said channel is adapted to receive the tongue member of another angle trim to connect said angle trims in an end to end relationship without requiring overlap of the first strips of said angle trims.

2. The angle trim according to claim 1, wherein said tongue member is an integrally formed portion of said first strip.

3. The angle trim according to claim 1 or 2, wherein said channel is integrally formed with said first strip.

4. The angle trim according to claim 3, wherein said channel is integrally formed by deforming a portion of said first strip.

5. The angle trim according to claim 1, further including one or more holes formed through said first strip to receive one or more fastening members.

* * * * *